US006352178B1

(12) United States Patent
Kimoto et al.

(10) Patent No.: US 6,352,178 B1
(45) Date of Patent: Mar. 5, 2002

(54) FLEXIBLE CONTAINER

(75) Inventors: Yuji Kimoto, Wakayama; Akira Ono, Ibaraki, both of (JP)

(73) Assignee: Wakayama Seika Kogyo Co., Ltd., Wakayama (JP)

( * ) Notice: Subject to any disclaimer, the term of this patent is extended or adjusted under 35 U.S.C. 154(b) by 0 days.

(21) Appl. No.: 09/673,625

(22) PCT Filed: Apr. 18, 2000

(86) PCT No.: PCT/JP00/02529

§ 371 Date: Jan. 2, 2001

§ 102(e) Date: Jan. 2, 2001

(87) PCT Pub. No.: WO00/64786

PCT Pub. Date: Nov. 12, 2000

(30) Foreign Application Priority Data

Apr. 22, 1999 (JP) ..... 11-114618

(51) Int. Cl.[7] ..... B65D 35/56
(52) U.S. Cl. ..... 222/105
(58) Field of Search ..... 222/105, 181, 222/181.2, 181.3

(56) References Cited

U.S. PATENT DOCUMENTS

| | | | | |
|---|---|---|---|---|
| 4,817,824 A | * | 4/1989 | LaFleur et al. | 222/105 |
| 4,966,311 A | * | 10/1990 | Taylor | 222/105 |
| 5,344,048 A | * | 9/1994 | Bonerb | 222/105 |
| 6,227,408 B1 | * | 5/2001 | Poulton | 222/105 |

FOREIGN PATENT DOCUMENTS

| | | |
|---|---|---|
| FR | 1489866 | 11/1967 |
| JP | 37-30807 | 11/1962 |
| JP | 38-14746 | 7/1963 |
| JP | 57-1187 | 1/1982 |
| JP | 60-38547 | 11/1985 |

* cited by examiner

*Primary Examiner*—Philippe Derakshani
*Assistant Examiner*—Thach H. Bui
(74) *Attorney, Agent, or Firm*—Wenderoth, Lind & Ponack, L.L.P.

(57) ABSTRACT

A flexible container excellent in durability and stability for storage and conveyance and capable to prevent the content in the flexible container from scattering. The flexible container is so constructed that a frame for fixedly supporting a storing bag is provided around the storing bag, so that the storing portion is accommodated in the frame; that the cylindrical injecting portion provided at the top of the storing portion and the cylindrical discharging portion provided at the bottom of the storing portion are extended to a given length from the frame to open to outside; that a folded portion is integrally formed around the outside of the storing bag at a portion thereof near a root portion of the cylindrical discharging portion of the storing bag placed in the frame; that a flange having a pair of ring-like fixing portions to fixedly hold the folded portion in sandwich relation therebetween and a cylindrical portion projecting from an inner periphery of one of the fixing portions is mounted to the folded portion, so that the cylindrical discharging portion is surrounded within the frame by the folded portion and the flange, to form an accommodating portion for accommodating therein the cylindrical discharging portion as folded; and that a lid is detachably provided at an opening of the cylindrical portion at its projecting side.

4 Claims, 11 Drawing Sheets

FLEXIBLE CONTAINER

TECHNICAL FIELD

The present invention relates to a flexible container for storing, mainly, materials such as fine particles in a manner so as to enable a conveyance of them.

BACKGROUND ART

In general, a bag-like, flexible container is used for storing a required amount of fine particles and carrying the same to plant facilities which produce final products from intermediates of fine particles such as chemicals and synthetic resins.

The flexible container includes a flexible storing bag comprising a storing portion; a foldable, cylindrical, injecting portion extending to a given length from the top of the storing portion and having a mouth opening to outside; and a foldable, cylindrical, discharging portion extending to a given length from the bottom of the storing portion and having a mouth opening to outside. The cylindrical injecting portion and the cylindrical discharging portion each have an open/close portion composed of a string to interrupt a communication between the storing portion and the outside.

In use of the flexible container, the cylindrical discharging portion is tied with its related string to interrupt the communication between the storing portion and the outside before the material is injected into the storing portion from the cylindrical injecting portion. After the storing portion is filled with the material, the cylindrical injecting portion is tied with its related string to interrupt the communication between the storing portion and the outside. When the material filled in the flexible container is used in the plant, the flexible container is lifted up to inject the fine particles from the cylindrical discharging portion into a material injecting aperture in the plant facilities.

In this conventional type of flexible container, the cylindrical discharging portion is so designed as to be tied with the string to interrupt the communication between the storing portion and the outside. Also, the cylindrical discharging portion is provided, at a root portion thereof, with a cover portion for covering the as-strung cylindrical discharging portion in a folded state, in order to keep the cylindrical discharging portion out of the conveyance way.

The cover portion is made of a material having flexibility, as is the case with the storing portion and the cylindrical discharging portion, and is constructed as follows. Pleats are formed around a root portion of the cylindrical discharging portion and also string inserting openings are provided at the ends of the pleats, respectively. A string is drawn through the string inserting openings to be wrung, so as to purse the cylindrical discharging portion, thereby covering the as-folded cylindrical discharging portion with the cover portion.

However, since the flexible container thus constructed has at its bottom the cylindrical discharging portion, the cover portion, made of the flexible material, for covering the cylindrical discharging portion is liable to damage during the conveyance. Thus, the conventional type of flexible container has a drawback in durability.

Also, since the flexible container is composed of the flexible storing bag, when the containers filled with the material are piled in consideration of storage space, poor stability is provided, so there is limitation on the number of containers laying one upon another.

In addition, since the cylindrical discharging portion of the flexible container is usually formed of the flexible material, when the content in the container is discharged from the cylindrical discharging portion as is opened, motion of the cylindrical discharging portion is produced and, as a result of this, the easy-to-scatter content, such as fine particles, scatters easily from the mouth of the cylindrical discharging portion. Thus, the conventional type of flexible container has a problem in working atmosphere.

To eliminate this problem, there may be the way of fixedly mounting the cylindrical discharging portion to a counterpart discharging opening by use of a band, a flange member or equivalent. But, since the conventional type of flexible container is put in a suspended state when the content is discharged, the cylindrical discharging portion varies in shape and thus twists from the start of discharging the content until the stop of the discharge. To avoid the twist being formed in the cylindrical discharging portion, the suspending state of the flexible container must be adjusted. If the amount of suspending is too much, a force larger than required is exerted on the cylindrical discharging portion, so that the breakage of the mounting portion of the cylindrical discharging portion or the disengagement of the band or equivalent therefrom may be caused.

In consideration of these drawbacks involved in the prior art, the present invention has been made. It is the object of the present invention to provide a flexible container excellent in durability and stability for storage and capable to prevent the content from scattering when the content in the flexible container is discharged.

DISCLOSURE OF THE INVENTION

To accomplish the abovesaid object, according to the present invention as set forth in claim 1 provides a novel flexible container comprising a flexible storing bag comprising a storing portion; a foldable, cylindrical, injecting portion extending to a given length from a top of the storing portion and having a mouth opening to outside; and a foldable, cylindrical, discharging portion extending to a given length from a bottom of the storing portion and having a mouth opening to outside, the cylindrical injecting portion and the cylindrical discharging portion each having an open/close portion for interrupting a communication between the storing portion and the outside, wherein a frame for fixedly supporting the storing bag is provided around the storing bag, so that the storing portion is accommodated in the frame, and the cylindrical injecting portion provided at the top of the storing portion is extendable to a given length from a top of the frame to open to outside, while also the cylindrical discharging portion provided at the bottom of the storing portion is extendable to a given length from a bottom of the frame to open to outside; wherein a folded portion is formed around the outside of the storing bag at a portion thereof near a root portion of the cylindrical discharging portion of the storing bag placed in the frame, and a flange having a pair of ring-like fixing portions to fixedly hold the folded portion in sandwich relation therebetween and a cylindrical portion projecting from an inner periphery of one of the fixing portions is mounted to the folded portion, so that the cylindrical discharging portion is surrounded by the folded portion and the flange within the frame, to form an accommodating portion for accommodating therein the cylindrical discharging portion as folded; and wherein a lid is detachably provided at an opening of the cylindrical portion at its projecting side, so that when the cylindrical discharging portion is folded into the accommodating portion, the accommodating portion is closed with the lid, while on the other hand, when the cylindrical discharging portion is extended, the lid is removed to render the accommodating portion to open to outside.

As defined in claim 2, since the storing portion of the storing bag is received in and supported by the frame, the protrusion of the storing portion of the present invention of claim 1 can be prevented by the frame. Therefore, improved stability at the time of storage and conveyance can be achieved, as compared with the conventional type of flexible container. Further, since the cylindrical discharging portion can be folded to be received in the interior of the frame, conveyance can be facilitated and also the number of flexible containers to be piled can be increased, thus providing the result that even limited storage space can be used to store a lot of flexible containers with high stability. Furthermore, since the accommodating portion is composed of the flange, improved durability is achieved. In addition, since the flexible container can be put into storage, with the cylindrical discharging portion accommodated in the accommodating portion composed of the flange, the cylindrical discharging portion can be protected against the damage at the time of storage. Also, since the storing bag is in the frame at the time of storage, the storing bag can also be protected from the damage. Moreover, since the cylindrical discharging portion is extended to discharge the content therefrom in the state of the storing bag being fixedly supported within the frame, the cylindrical discharging portion and the storing portion can be always kept at the same levels while the content is discharged from the cylindrical discharging portion. Thus, the cylindrical discharging portion can be prevented from being drawn upwards while the content is discharged. As a result of this, the cylindrical discharging portion can be prevented from being strained, thus providing the advantages that the cylindrical discharging portion is protected against the damage and the scattering of the discharged material is prevented.

Also, according claim 3, the present invention as set forth in any of claims 1 or 2, a folded portion is formed around an outside of the cylindrical discharging portion at an end portion thereof near the mouth of the cylindrical discharging portion, and a flange is mounted to the folded portion.

With this construction, the folded portion can be connected to a material injecting opening in the plant facilities, thus providing the advantage of enabling the content in the storing bag to be fed in without scattering.

Further, according to the present invention, the cylindrical injecting portion may be surrounded in the frame by a folded portion formed around the outside of the storing bag at a portion thereof near a root portion of the cylindrical injecting portion of the storing bag placed in the frame and a flange having a pair of ring-like fixing portions mounted to the folded portion to fixedly hold the folded portion in sandwich relation therebetween and a cylindrical portion projecting from an inner periphery of one of the fixing portions, to form an accommodating portion for accommodating therein the cylindrical injecting portion as folded, and a lid may be detachably provided at an opening of the cylindrical portion at its projecting side.

With this construction, since the accommodating portion is composed of the flange, improved durability is achieved. In addition, since the flexible container can be put into storage, with the cylindrical injecting portion accommodated in the accommodating portion composed of the flange, the cylindrical injecting portion can also be protected against the damage at the time of storage. In addition, since the storing bag is in the frame at the time of storage, the storing bag can also be protected from the damage.

BEST MODE FOR CARRYING OUT THE INVENTION

Referring now to the accompanying drawings, an example of the preferred embodiment of the present invention will be described below.

Figure 1:
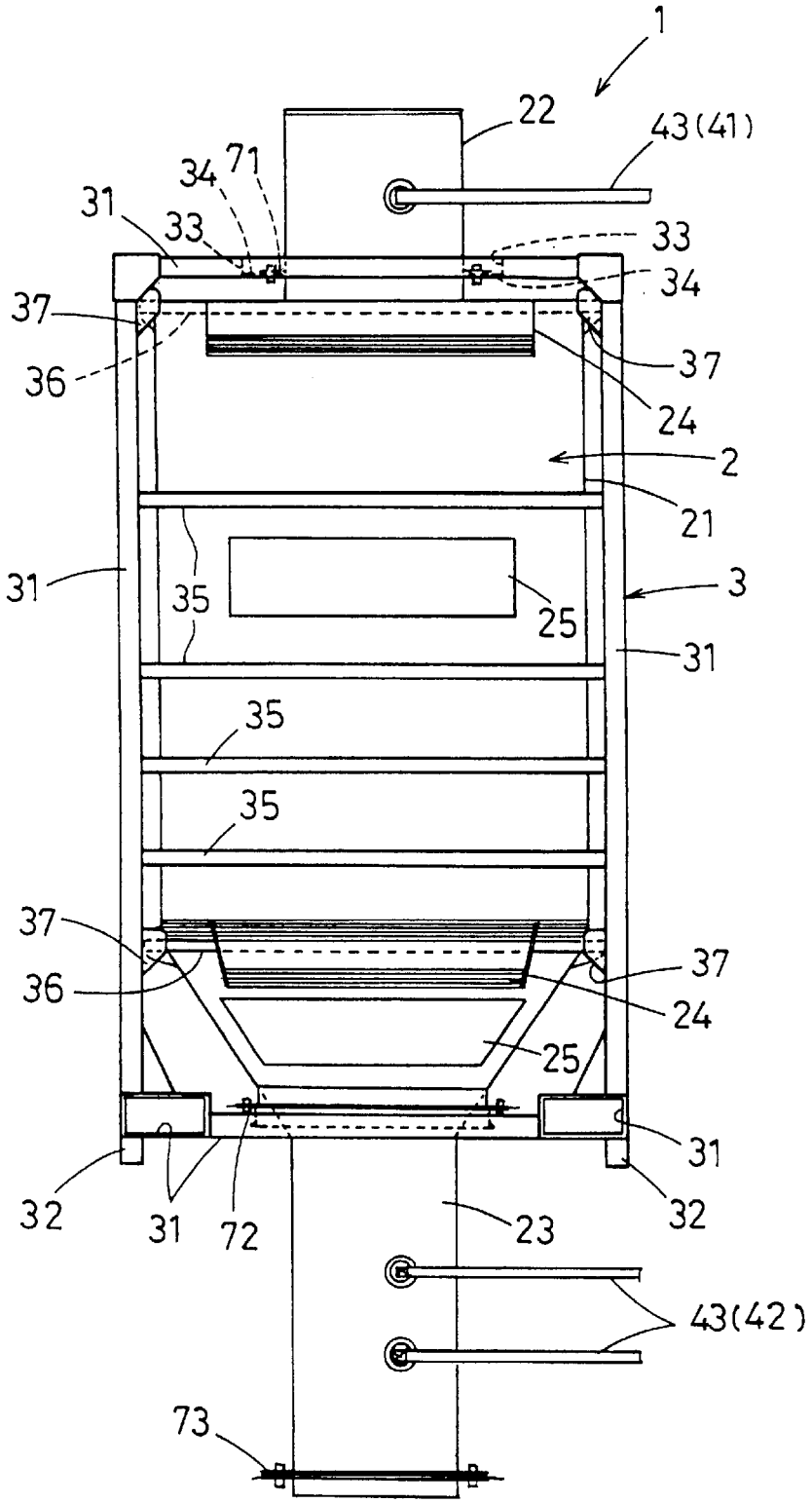
FIG. 1 is a side view of a flexible container according to the present invention, showing the state before being filled with materials.

FIG. 1 is a side view of a flexible container 1 of the present invention. The flexible container 1 comprises a storing bag 2 having flexibility and a flange 3, provided around the storing bag 2, for fixedly supporting the storing bag 2 thereto.

Figure 4:
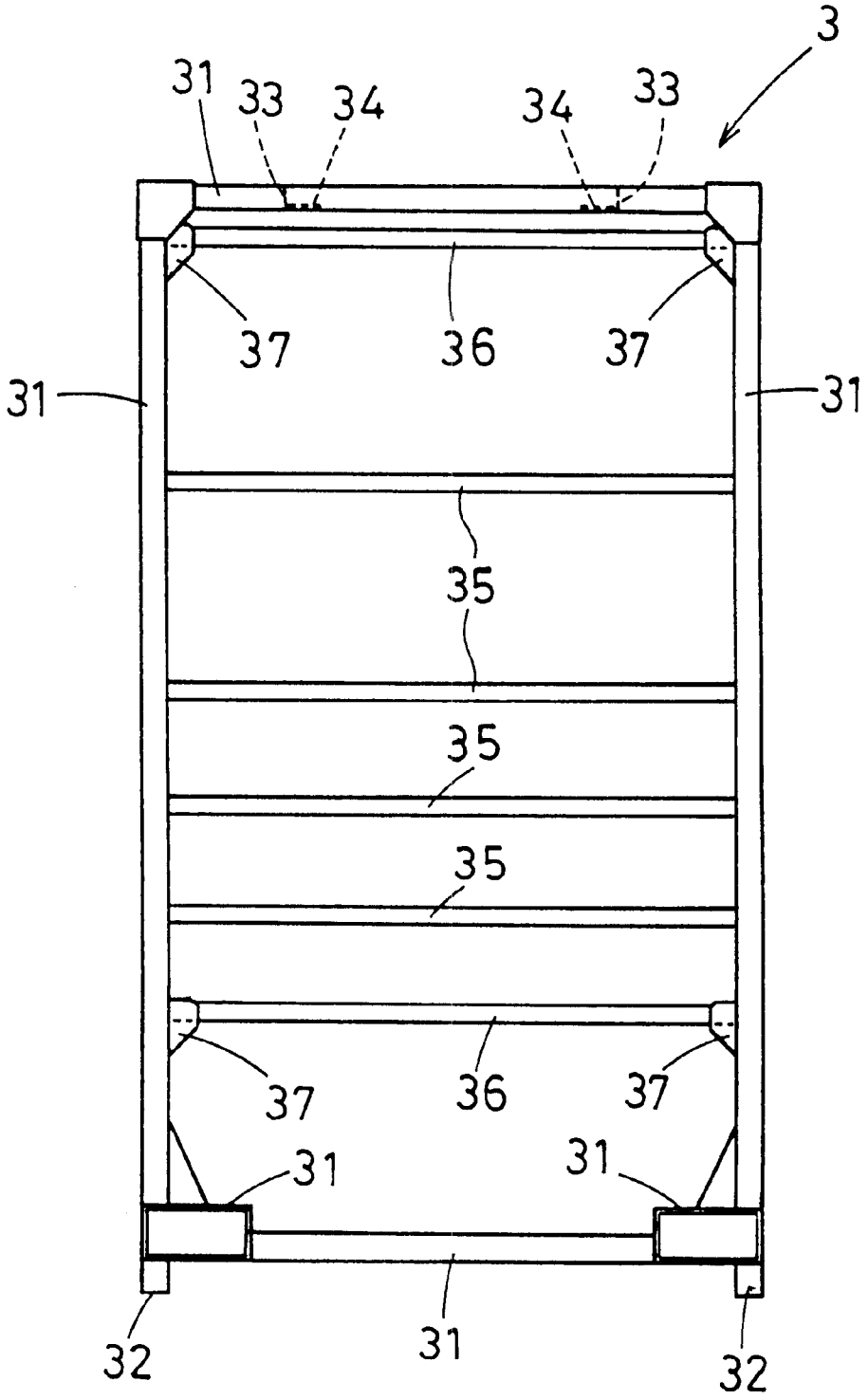
FIG. 4 is a side view of a frame of the flexible container according to the present invention.
Figure 5:
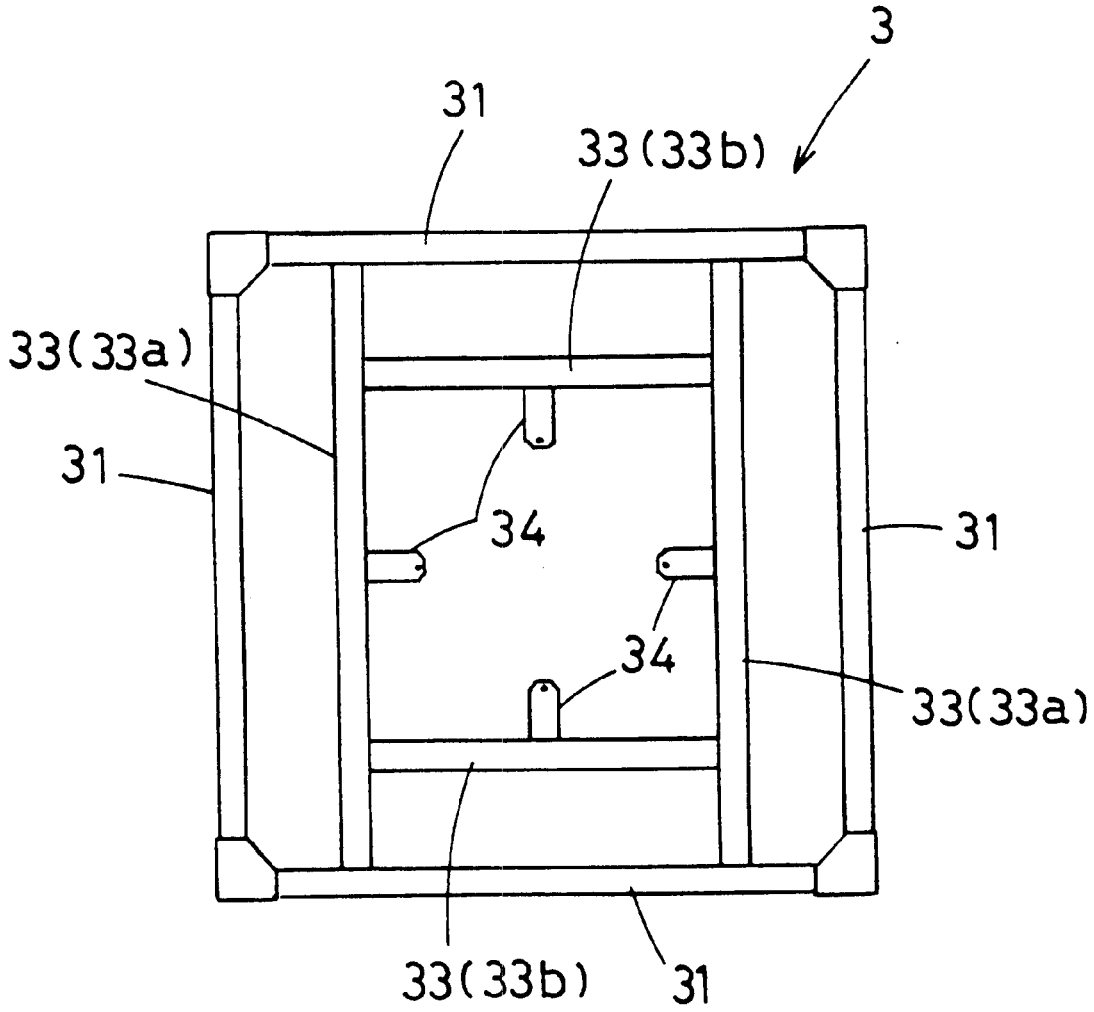
FIG. 5 is a top view of the frame of FIG. 4.

The frame 3 has a rectangular parallelepiped shape formed by twelve main frames 31 fixedly assembled by welding, as shown in FIGS. 4 and 5. The main frames 31 forming a quadrilateral at the top all have a L-shaped section. On the other hand, two of the main frames 31 forming a quadrilateral at the bottom have a L-shaped section and two others have a hollow body having a rectangular section and opening at the opposite ends, for the sake of conveyance convenience by a lift. Four main frames 31 extending vertically between the top and bottom quadrilaterals at the corners each have a hollow body having a square section.

Figure 3:
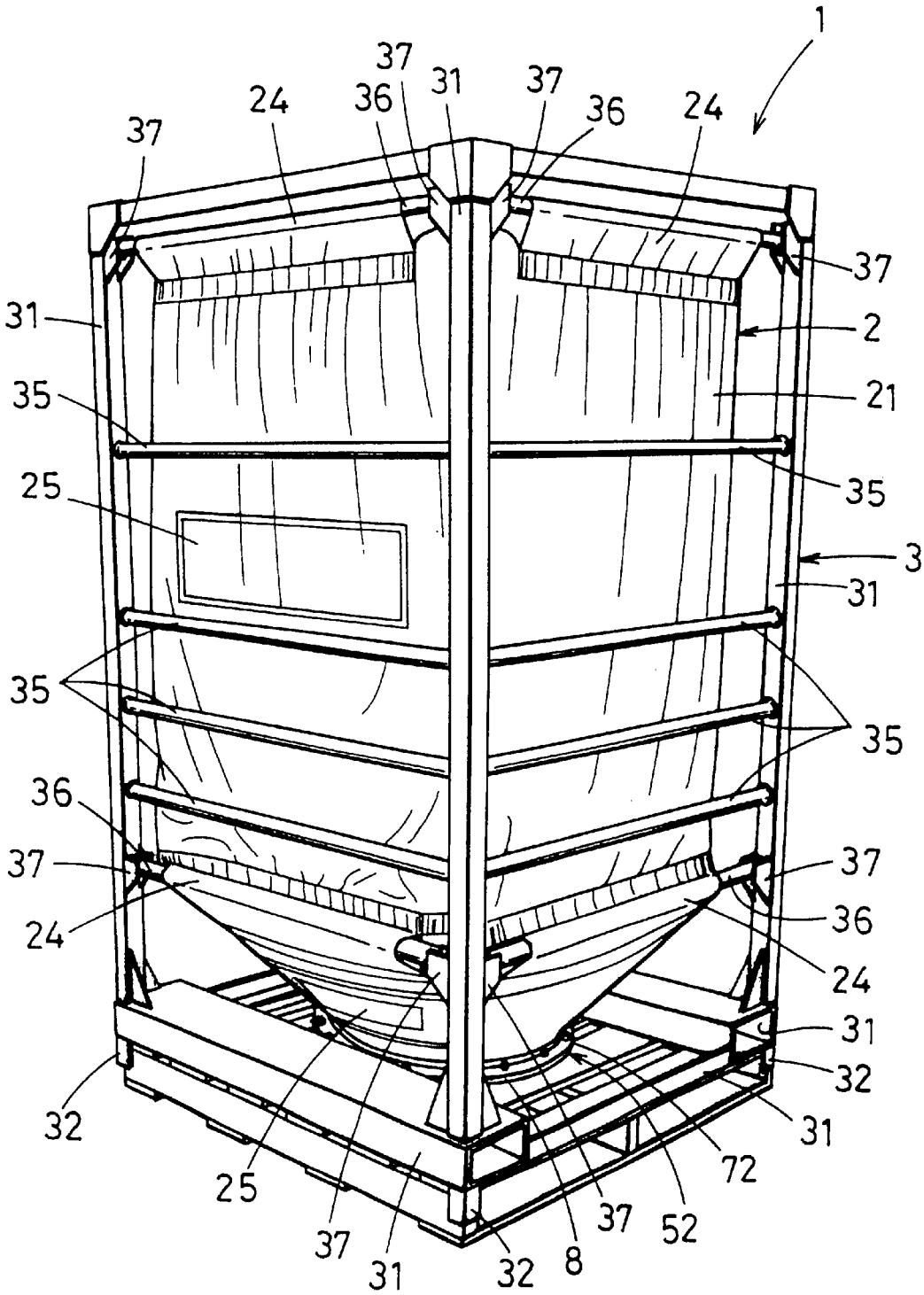
FIG. 3 is a perspective view of the flexible container according to the present invention, showing the state after being filled with the materials.

Formed at the bottom of the frame 3 at the four corners are supporting pieces 32 of a L-shaped section. The supporting pieces 32 are means for positioning the container in place on a carriage, as shown in FIG. 3.

Further, the frame 3 is provided, at a top thereof, with flange mounting frames 33 having a L-shaped section for mounting a first flange 71 provided at the storing bag 2 discussed later. As shown in FIG. 5, the flange mounting frames 33 comprise two flange mounting frames 33*a* extending between two opposing main frames 31 of the four main frames 31 and two flange mounting frames 33*b* extending between the two flange mounting frames 33*a*.

Four mounting pieces 34 for the first flange 71 are provided at the inside of the square formed by the four flange mounting frames 33. The mounting pieces 34 are formed at positions lower than top surfaces of the main frames 31 so that when the first flange 71 is mounted, the first flange 71 does not project from the frame 3.

Further, the frame 3 is provided, at each side thereof, with two or more cylindrical holding frames 35 for preventing the frame 3 from protruding when the intermediates such as fine particles are filled in the storing bag 2. In the illustrated embodiment, four holding frames 35 are provided at each side of the frame 3, with the spaces between the holding frames becoming gradually narrower toward the bottom, in consideration of the degree of protrusion of the storing bag 2 becoming large at the lower side when the storing bag 2 is filled with the intermediates.

Four supporting frames 36 for fixedly supporting the storing bag 2 to the frame 3 are detachably mounted to the main frames 31 at a position lower than the main frames 31 at the uppermost end and at a position lower than the main frames 31 at the lowermost end, respectively.

In the main frames 31, mounting portions 37 for mounting the supporting frames 36 thereto are formed. The mounting portions 37 are so structured as to receive therein the supporting frames 36 from the above, holding the bottom thereof and fixing them thereto with bolts.

Figure 6:
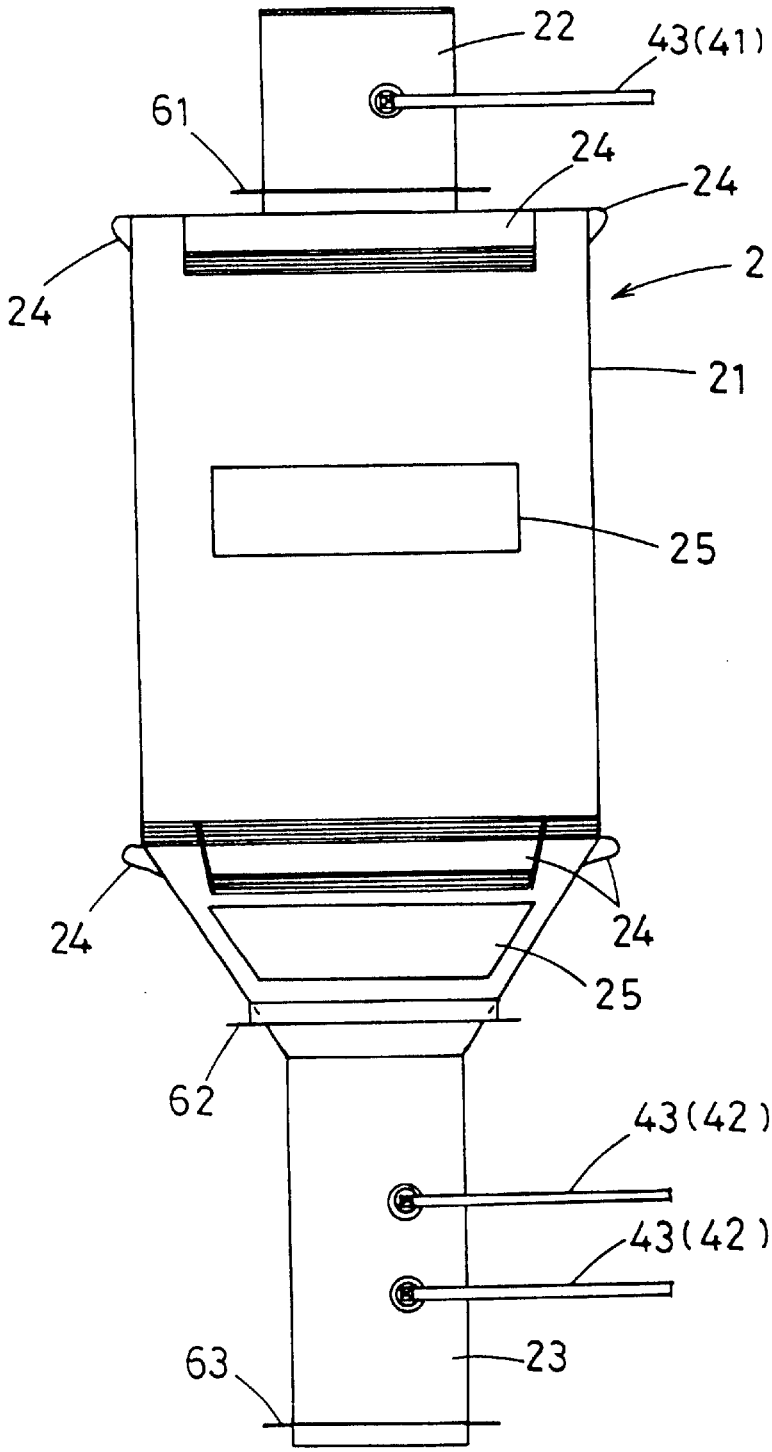
FIG. 6 is a side view of a storing bag of the flexible container according to the present invention.
Figure 7:
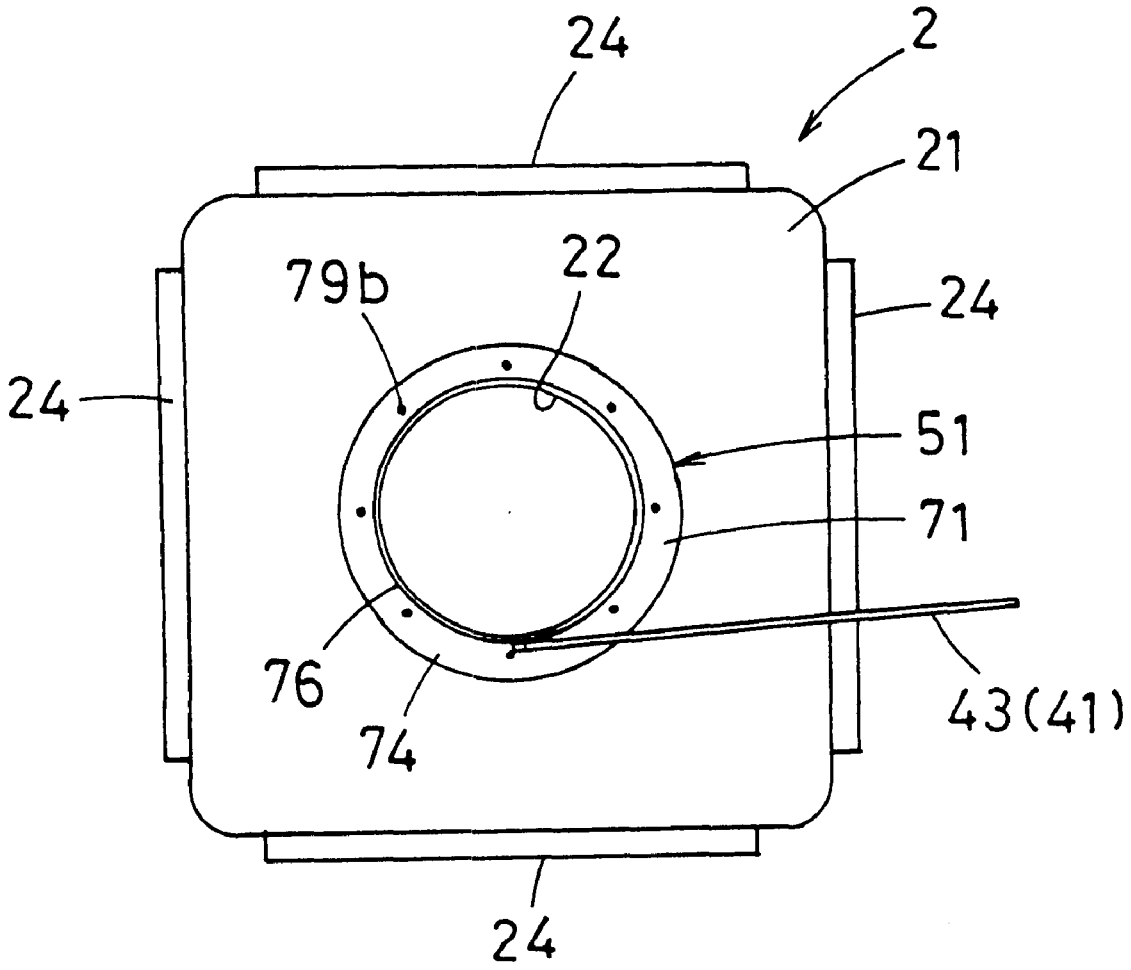
FIG. 7 is a top view of the storing bag of FIG. 6.

Description on the storing bag 2 will now be given with reference to FIGS. 6 and 7. The entire storing bag 2 is made of a material having flexibility such as vinyl chloride and formed into a bag-like form. The storing bag 2 includes a storing portion 21 to be received within the frame 3; a cylindrical injecting portion 22 formed continuously from a top center portion of the storing portion 21 so that it can extend from a top of the frame 3 to a given length to open to outside; and a cylindrical discharging portion 23 formed continuously from a bottom center portion of the storing portion 21 so that it can extend from a bottom of the frame 3 to a given length to open to outside.

The storing portion 21 is formed to store the intermediates such as fine particles. The storing portion has a square pole shape which is tapered to be conical in shape at its lower portion. The cylindrical discharging portion 23 is formed in continuation to the lower tapered portion of the storing portion.

Further, the storing portion 21 is provided with cylindrical supporting portions 24 integrally formed therewith at four upper portions thereof and at four lower portions thereof respectively. The cylindrical supporting portions 24 extend horizontally, passing therethrough the supporting frames 36 of the frame 3 to fixedly support the storing portion 21 to the frame 3. The conical portion of the storing portion is provided, at a lower portion thereof, with a second folded portion 62 for mounting thereto a second flange 72 as mentioned later. The second folded portion 62 is so designed as to be placed within the frame 3 when the storing bag 2 is fixed to the frame 3. The second folded portion 62 may be integrally formed with the storing portion 21 or may be adapted to be attached on an outside surface of the storing portion 21 separately by stitching or adhesive bonding.

When the intermediates filled in the storing portion 21 are discharged, an impact is given to a side surface of the storing portion 21 for facilitating the flow of the intermediates. For providing increased strength of the parts of the storing portion to which the impact is given, reinforced portions 25, 25 having an increased thickness are provided at two opposing sides of the storing portion 21 at the top and the bottom thereof.

The cylindrical injecting portion 22 at the top of the storing portion 21 is provided, at its root portion connected to the storing portion 21, with a first folded portion 61 for mounting the first flange 71 therein. As is the case with the second folded portion 62, the first folded portion 61 is so designed as to be placed within the frame 3 when the storing bag 2 is fixed to the frame 3. The first folded portion 61 may be integrally formed with the cylindrical injecting portion 22 or may be adapted to be attached on an outside surface of the cylindrical injecting portion 22 separately by stitching or adhesive bonding.

Further, a string 43 is fixed to an outside surface of the cylindrical injecting portion 22 at a vertical middle portion thereof. The string 43 forms a first open/close portion 41 for enabling the communication between the storing portion 21 and the outside to be interrupted. The communication between the storing portion 21 and the outside is interrupted at the cylindrical injecting portion 22 by binding the cylindrical injecting portion 22 at the intermediate portion thereof.

Also, two strings 43 are fixed to the cylindrical discharging portion 23 at a vertical middle portion thereof. The strings 43 form a second open/close portion 42 for enabling the communication between the storing portion 21 and the outside to be interrupted. The communication between the storing portion 21 and the outside is interrupted at the cylindrical discharging portion 23 by binding the cylindrical discharging portion 23 at an intermediate portion thereof.

Further, the cylindrical discharging portion 23 is provided, at its portion close to the mouth, with a third folded portion 63 for mounting thereon a third flange 73 mentioned later. The third folded portion 63 may be integrally formed with the cylindrical discharging portion 23 or may be adapted to be attached on an outside surface of the cylindrical discharging portion 23 separately by stitching or adhesive bonding.

Figure 2:
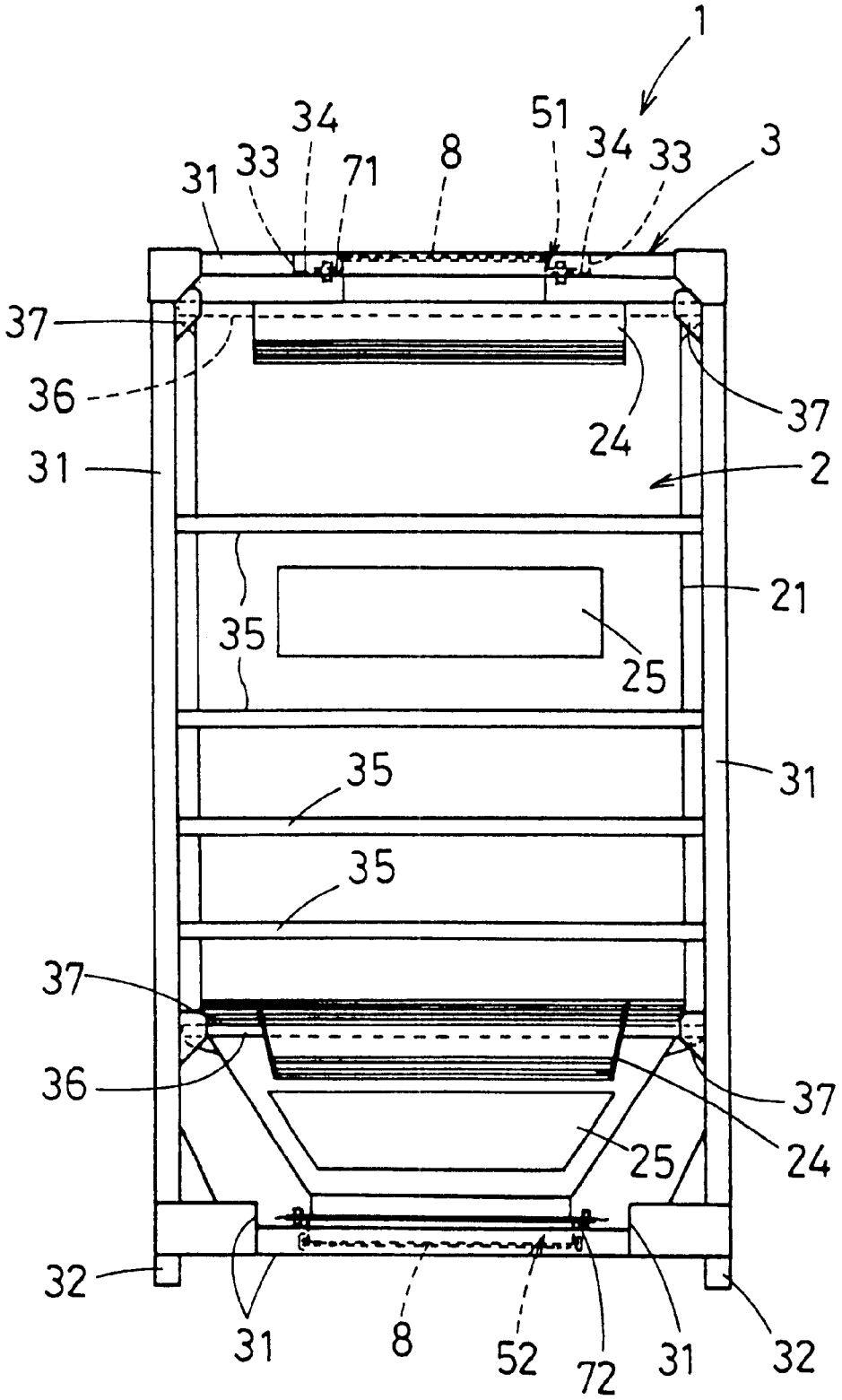
FIG. 2 is a side view of the flexible container according to the present invention, showing the state after being filled with the materials.

In the illustrated embodiment, the first flange 71 and the second flange 72 are mounted to the cylindrical injecting portion 22 and the cylindrical discharging portion 23 of the storing bag 2 to be placed in the frame 3 in the proximity of their root portions, respectively, or are mounted to the first folded portion 61 provided at the cylindrical injecting portion 22 and the second folded portion 62 provided at the storing portion 21, respectively, as shown in FIGS. 1 and 2, thereby forming the first accommodating portion 51 and the second accommodating portion 52 which encircle the cylindrical injecting portion 22 and the cylindrical discharging portion 23 and accommodate therein the cylindrical injecting portion 22 as folded and the cylindrical discharging portion 23 as folded.

The accommodating portion 51 is provided with the first folded portion 61 and the first flange 71 mounted on the first folded portion 61, and the accommodating portion 52 is provided with the second folded portion 62 and the second flange 72 mounted on the second folded portion 62. An opening of the first flange 71 and an opening of the second flange 72 are opened and closed with lids 8.

Figure 9:
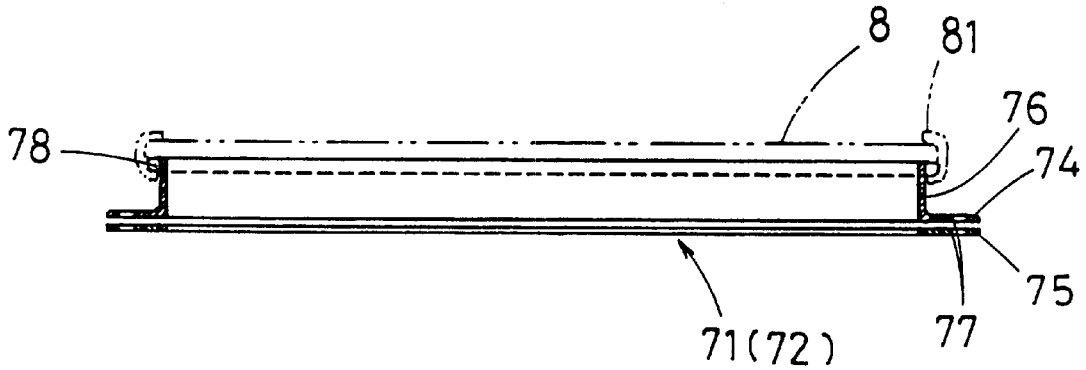
FIG. 9 is a sectional view of the first flange of FIG. 8.
Figure 10:
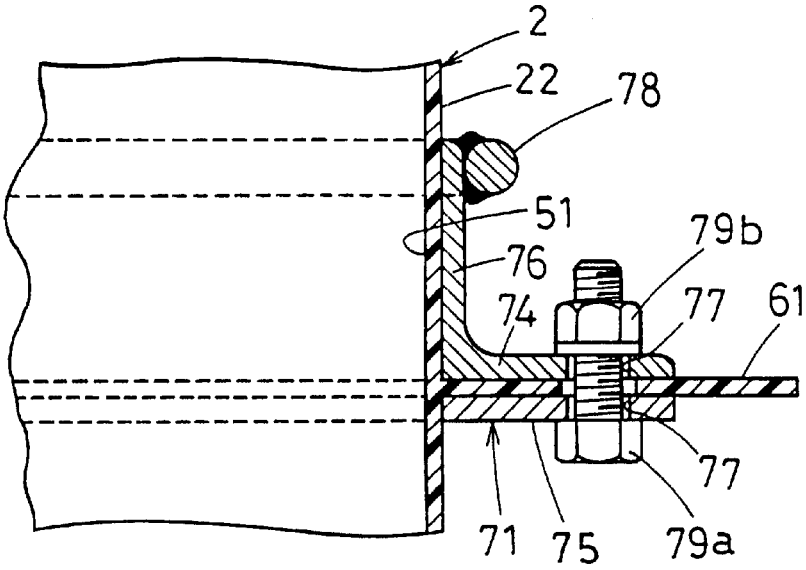
FIG. 10 is a sectional view of a principal part of a first accommodating portion.

The accommodating portions 51, 52 are structured such that they can be closed with the lids 8 when the cylindrical injecting portion 22 and the cylindrical discharging portion 23 are folded and can be opened to the outside by removing the lids 8 when the cylindrical injecting portion 22 and the cylindrical discharging portion 23 are extended, as shown in FIGS. 2 and 9. The respective accommodating portions 51, 52 are placed in the interior of the frame 3.

Figure 8:
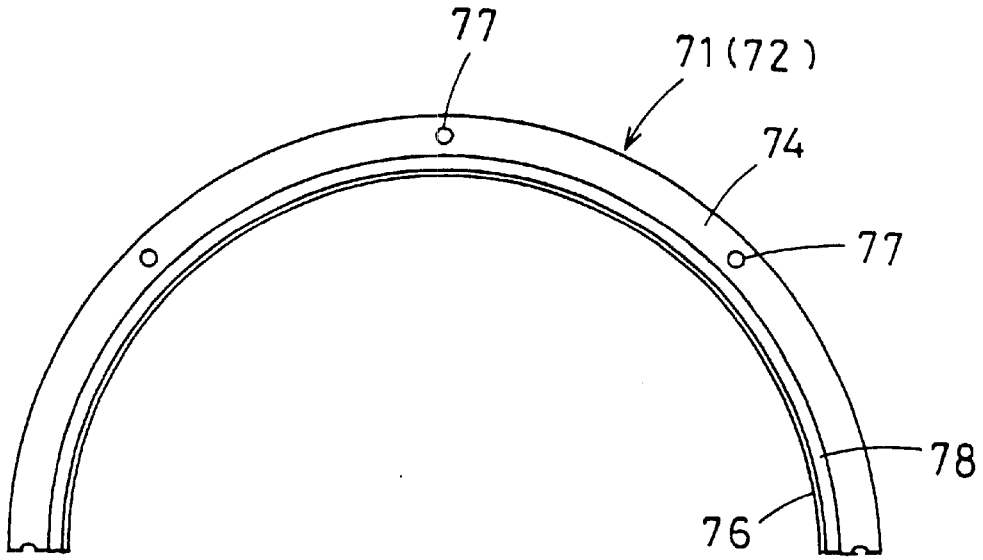
FIG. 8 is a top view of a half a first flange.

As the first flange 71 and the second flange 72 are identical to each other in construction, the description on the first flange 71 and the second flange 72 will be given with reference to FIGS. 8 and 9. The first flange 71 (the second Range 72) includes a pair of ring-like fixing portions 74, 75 which are fixed holding the first folded portion 61 (the second folded portion 62) in sandwich relation therebetween; and a cylindrical portion 76 projecting from a radially inner end portion of one of the fixing portions 74.

The fixing portions 74, 75 form therein fixing bolt inserting holes 77. Around an end portion of the cylindrical portion 76 of the one fixing portion 74, a bar is fixed by welding to form a ring-like projection 78, so that the lid 8 is fixed at the projection 78.

In fixing the first flange 71 to the first folded portion 61, the first flange 71 is fixed to the first folded portion 61 with bolts 79*a* and nuts 79*b*, with the first folded portion 61 held in sandwich relation between the pair of fixing portions 74, 75. The first flange 71 is fixed to the first folded portion 61, with the cylindrical portion 76 of the one fixing portion 74 oriented toward the opening of the cylindrical injecting portion 22.

The lid 8 is rendered removable so that the opening of the cylindrical portion 76 at the projecting side can be opened or closed. In detail, there is provided a mounting frame 81 with which the marginal portion of the lid 8 closing the opening of the cylindrical portion 76 at its projected side and the projection 78 provided at the cylindrical portion 76 are covered. By attachment to or detachment of the mounting frame 81 from the cylindrical portion 76, the lid 8 is attached to or detached from the cylindrical portion 76, to open or close the opening of the cylindrical portion 76.

Figure 11:
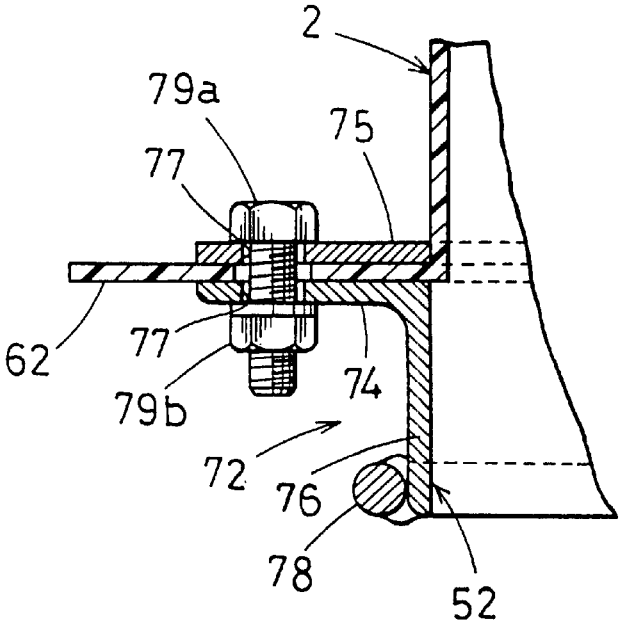
FIG. 11 is a sectional view of a principal part of a second accommodating portion.

As is the case of the first flange 71, the second flange 72 is fixed to the second folded portion 62 with bolts 79*a* and nuts 79*b*, with the second folded portion 62 held in sandwich relation between the pair of fixing portions 74, 75, as shown in FIG. 11. The second flange 72 is mounted to the second folded portion 62, with the cylindrical portion 76 of the one fixing portion 74 oriented toward the cylindrical discharging portion 23.

Further, the third flange 73 is mounted to the third folded portion 63 provided in the proximity of the end of the mouth of the cylindrical discharging portion 23. The third flange 73 is used for connecting the cylindrical discharging portion 23 to a material injecting opening at the discharging side when the intermediates filled in the storing portion 21 are discharged through the cylindrical discharging portion 23.

Figure 12:
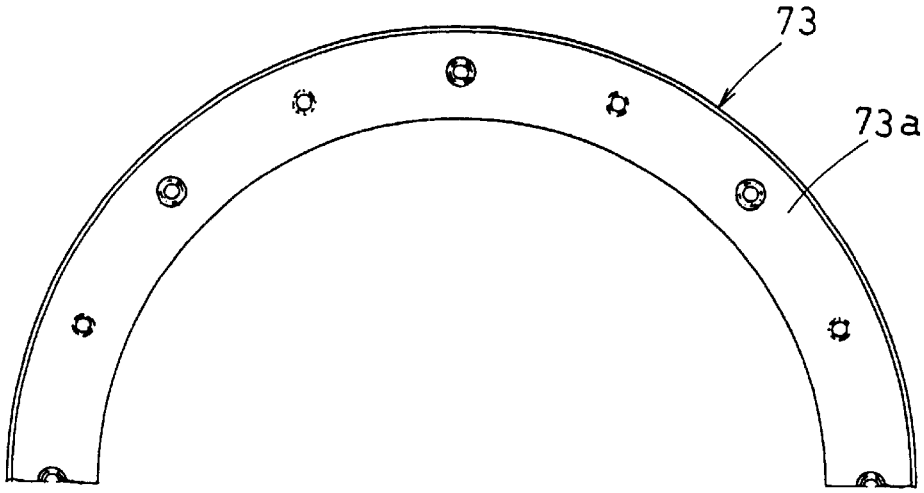
FIG. 12 is a top view of a half a third flange.
Figure 13:
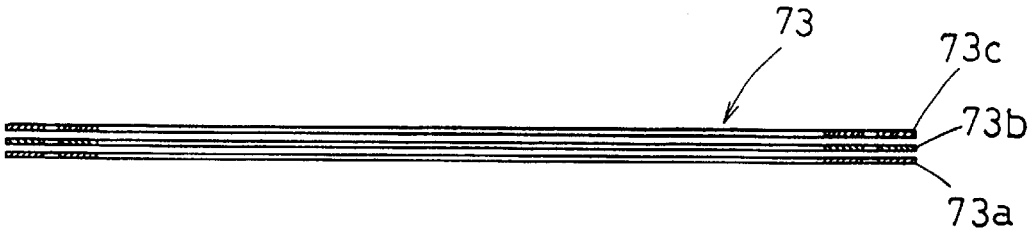
FIG. 13 is a sectional view of the third flange of FIG. 12.
Figure 14:
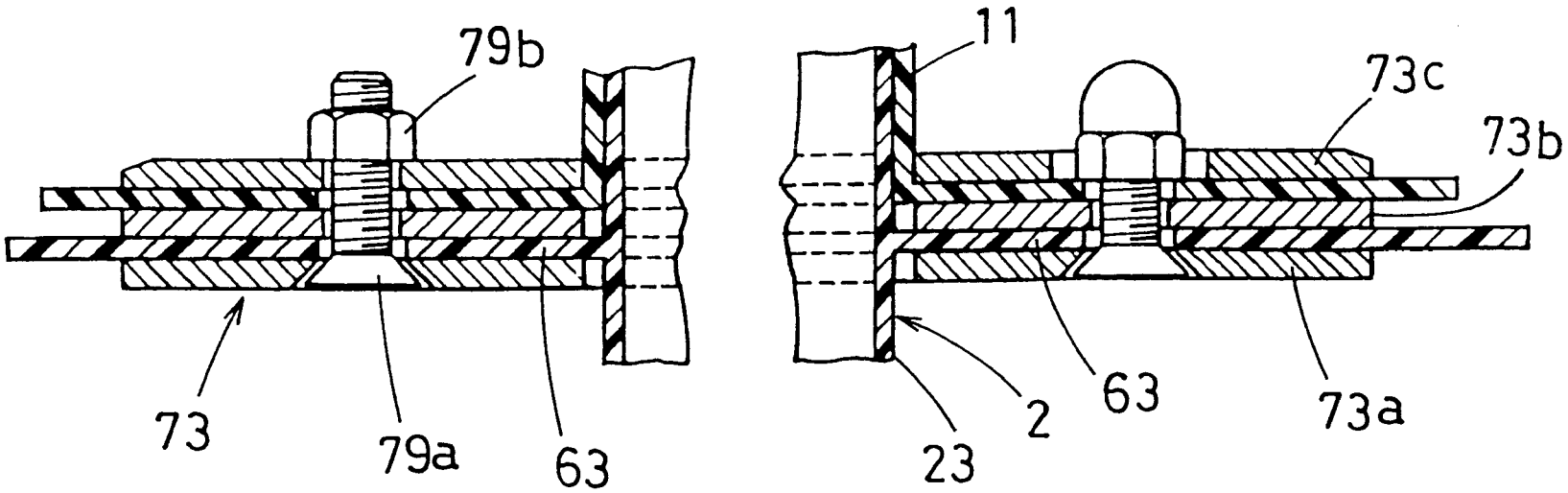
FIG. 14 is a sectional view of a principal part, showing the state of the third flange being mounted.

The third flange 73 is composed of three ring members 73*a*, 73*b*, 73*c*, as shown in FIGS. 12 and 13. When the third flange 73 is mounted to the third folded portion, the third folded portion 63 is held in sandwich relation between the first ring member 73*a* provided at the opening side of the cylindrical discharging portion 23 and the second ring member 73*b* provided at the middle. Also, a thin, cylindrical, polyethylene sheet 11 is held in sandwich relation between the second ring member 73*b* and the third ring member 73*c* at the side of the storing portion 21 and is fixed therebetween with the bolts 79*a* and nuts 79*b*.

The cylindrical polyethylene sheet 11 is arranged to extend upwardly from between the third ring member 73*c* and the cylindrical discharging portion 23. After completion of the discharge of the intermediates from the cylindrical discharging portion 23, the cylindrical polyethylene sheet 11 is used to wrap up the third flange 73 and is strung at the opening, to prevent the intermediates in the interior of the cylindrical discharging portion 23 from scattering.

Operation of the illustrated embodiment of the invention will be described below. Before the intermediates are filled in the storing bag 2, the flexible container of the invention is put in the state in which the cylindrical injecting portion 22 and the cylindrical discharging portion 23 are extended to ensure the communication between the storing portion 21 and the outside, as shown in FIG. 1. After the cylindrical discharging portion 23 is tied with the strings 43 thereat to interrupt the communication at the cylindrical discharging portion 23, the thus interrupted cylindrical discharging portion 23 is folded and received in the interior of the second flange 72 or in the second accommodating portion 52, together with the third flange 73. Then, the second flange 72 is closed with the lid 8 at the cylindrical portion 76. Thereafter, the filing of the intermediates in the storing portion 21 is started.

After completion of the filling of the intermediates in the storing portion 21, the cylindrical injecting portion 22 is tied with the string 43 to interrupt the communication at the cylindrical injecting portion 22. Subsequently, the cylindrical injecting portion 22 is folded and received in the interior of the first flange 71 or in the first accommodating portion 51. Then, the first flange 71 is closed with the lid 8 at the cylindrical portion 76, as shown in FIG. 2.

On the other hand, when the intermediates in the storing bag 2 are discharged, the lid 8 closing the cylindrical portion 76 of the second flange 72 is removed first, to allow the second accommodating portion 52 to open to the outside. Subsequently, the cylindrical discharging portion 23 is taken out and is connected to an intermediate injecting opening in the plant facilities. Then, the strings 43 tying the cylindrical discharging portion 23 is untied to discharge the intermediates in the storing portion 21.

As seen from the above, when the intermediates are filled in the storing bag 2, the storing portion 21 of the storing bag 2 is fixedly supported in the state of being received in the frame 3, so that the storing portion 21 supported by the frame 3 is prevented from being protruded by the holding frames 35 of the frame 3. Therefore, improved stability for storage and conveyance can be achieved, as compared with the conventional type of flexible container.

Further, as shown in FIGS. 2 and 3, the cylindrical injecting portion 22 and the cylindrical discharging portion 23 can be folded to be received in the interior of the frame 3. Accordingly, the conveyance can be facilitated and also the number of flexible containers 1 to be piled can be increased, thus providing the result that even limited storage space can be used to store a lot of flexible containers 1 with high stability.

Furthermore, since the second accommodating portion 52 is composed of the second flange 72, excellent durability is achieved. In addition, since the flexible container 1 can be put into storage, with the cylindrical discharging portion 23 accommodated in the second accommodating portion 52 composed of the second flange 72, the cylindrical discharging portion 23 is protected against the damage at the time of storage. Also, since the storing bag 2 is in the frame 3 at the time of storage, the storing bag can also be protected from the damage.

Besides, the folded portion 63 is formed on an end portion of the cylindrical discharging portion 23 near its mouth, and the flange 73 is mounted to the folded portion 63 so that it can be connected to the material injecting opening in the plant facilities. This can provide the advantage of enabling the content in the storing bag 2 to be fed in without scattering.

Further, at that time, the cylindrical discharging portion 23 is extended to discharge the content therefrom in the state of the storing bag 2 being fixedly supported within the frame 3. Accordingly, the cylindrical discharging portion 23 and the storing portion 21 can always be kept at the same levels while the content is discharged from the cylindrical discharging portion. Thus, the cylindrical discharging portion 23 can be prevented from being drawn upwards while the content is discharged. As a result of this, the cylindrical discharging portion 23 can be prevented from being strained, so that the cylindrical discharging portion 23 is protected against the damage and the scattering of the discharged material is prevented.

Capability of Exploitation in Industry

According to the present invention, the storing portion of the storing bag is fixedly supported in the state of being received in the frame, so that the storing portion is supported by the frame and is prevented from being protruded by the holding frames of the frame. Therefore, improved stability for storage and conveyance can be achieved, as compared with the conventional type of flexible container.

Further, the cylindrical discharging portion can be folded to be received in the interior of the frame. Accordingly, the conveyance can be facilitated and also the number of flexible containers to be piled can be increased, thus providing the result that even limited storage space can be used to store a lot of flexible containers with high stability.

Furthermore, since the accommodating portion is composed of the flange, excellent durability is achieved. In addition, since the flexible container can be put into storage, with the cylindrical discharging portion and cylindrical injecting portion composed of the flange, the cylindrical discharging portion and the cylindrical injecting portion are protected against the damage at the time of storage. Also, since the storing bag is in the frame at the time of storage, the storing bag can also be protected from the damage.

Besides, the folded portion is formed on an end portion of the cylindrical discharging portion near its mouth, and the flange is mounted to the folded portion so that it can be connected to the material injecting opening in the plant facilities. This can provide the advantage of enabling the content in the storing bag to be fed in without scattering.

Further, the cylindrical discharging portion is extended to discharge the content therefrom in the state of the storing bag being fixedly supported within the frame. Accordingly, the cylindrical discharging portion and the storing portion can always be kept at the same levels while the content is discharged from the cylindrical discharging portion. Thus, the cylindrical discharging portion can be prevented from being drawn upwards while the content is discharged. As a result of this, the cylindrical discharging portion can be prevented from being strained, so that the cylindrical discharging portion is protected against the damage and the scattering of the discharged material is prevented.

What is claimed is:

1. A flexible container comprising a flexible storing bag (2) comprising a storing portion (21); a foldable, cylindrical, injecting portion (22) extending to a given length from a top of said storing portion (21) and having a mouth opening to outside; and a foldable, cylindrical, discharging portion (23) extending to a given length from a bottom of said storing portion (21) and having a mouth opening to outside, said cylindrical injecting portion (22) and said cylindrical discharging portion (23) each having an open/close portion (41, 42) for interrupting a communication between said storing portion (21) and the outside; and a frame (3) provided around said storing bag (2) for fixedly supporting said storing bag (2), so that said storing portion (21) is accommodated in said frame (3), and said cylindrical injecting portion (22) provided at the top of said storing portion (21) is extendable to a given length from a top of said frame (3) to open to outside, while also said cylindrical discharging portion (23) provided at the bottom of said storing portion (21) is extendable to a given length from a bottom of said frame (3) to open to outside, characterized in:

that a third folded portion (63) is formed around an outside of said cylindrical discharging portion (23) at an end portion thereof near a mouth of said cylindrical discharging portion (23), the open/close portion (42) is formed to an outside surface of said cylindrical discharging portion (23) at a position upper than said third folded portion (63) for interrupting a communication between said storing portion (21) and the outside, and a flange (73) composed of a pair of ring memebers **(73*a*)(73*b*) fixedly holds said third folded portion (63) in sandwich relation therebetween, said third flange (73) is connected to a material injection opening for injecting material stored in said storing bag (2); and that a second folded portion (62) is formed around the outside of said storing bag (2) at a portion thereof near a root portion of said cylindrical discharging portion (23) of said storing bag (2) placed in said frame (3), and a second flange (72) having a pair of ring-like fixing portions (74),(75) to fixedly hold said folded second portion (62) in sandwich relation therebetween and a cylindrical portion (76) projecting from an inner periphery of one said fixing portions (74) is mounted to said second folded portion (62), so that cylindrical discharging portion (23) is surrounded by said second folded portion (62) and said second flange (72) within said frame (3), to form an accommodating portion (52) for accomodating therein said cylindrical discharging portion (23) as folded, said third flange (73)**.

2. A flexible container according to claim 1, wherein a lid (8) is detachably provided at an opening of said cylindrical portion (76) at its projecting side, so that when said cylindrical discharging portion (23) is folded into said second accomodating portion (52), said second accomodating portion (52) is closed with said lid (8), while on the other hand, when said cylindrical discharging portion (23) is extended, said lid (8) is removed to render said second accomodating portion (52) to open to outside.

3. A flexible container according to claim 1, wherein said cylindrical injecting portion (22) is surrounded in said frame (3) by a first folded portion (61) formed around the outside of said storing bag (2) at a portion thereof near a root portion of said cylindrical injecting portion (22) of said storing bag (2) placed in said frame (3) and a first flange (71) having a pair of ring-like fixing portions (74),(75) mounted to said first folded portion (61) to fixedly hold said folded portion (61) in sandwich relation therebetween and a cylindrical first portion (76) projecting from an inner periphery of one of said fixing portions (74), to form a first accommodating portion (51) for accommodating therein said cylindrical injecting portion (22) as folded, and a lid (8) is detachably provided at an opening of said cylindrical portion (76) at its projecting side.

4. A flexible container according to claim 2, wherein said cylindrical injecting portion (22) is surrounded in said frame (3) by a first folded portion (61) formed around the outside of said storing bag (2) at a portion thereof near a root portion of said cylindrical injecting portion (22) of said storing bag (2) placed in said frame (3) and a first flange (71) having a pair of ring-like fixing portions (74),(75) mounted to said first folded portion (61) to fixedly hold said folded portion (61) in sandwich relation therebetween and a cylindrical first portion (76) projecting from an inner periphery of one of said fixing portions (74), to form a first accommodating portion (51) for accommodating therein said cylindrical injecting portion (22) as folded, and a lid (8) is detachably provided at an opening of said cylindrical portion (76) at its projecting side.

* * * * *